US011289026B2

(12) United States Patent
Yang et al.

(10) Patent No.: US 11,289,026 B2
(45) Date of Patent: Mar. 29, 2022

(54) PIXEL CIRCUIT, DRIVING METHOD THEREOF, DISPLAY SUBSTRATE AND DISPLAY DEVICE

(71) Applicant: BOE TECHNOLOGY GROUP CO., LTD., Beijing (CN)

(72) Inventors: Ming Yang, Beijing (CN); Can Zhang, Beijing (CN); Shengji Yang, Beijing (CN); Weihai Wang, Beijing (CN); Minghua Xuan, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/267,547

(22) PCT Filed: Jun. 8, 2020

(86) PCT No.: PCT/CN2020/094817
§ 371 (c)(1),
(2) Date: Feb. 10, 2021

(87) PCT Pub. No.: WO2020/248922
PCT Pub. Date: Dec. 17, 2020

(65) Prior Publication Data

US 2021/0312859 A1 Oct. 7, 2021

(30) Foreign Application Priority Data

Jun. 12, 2019 (CN) ..... 201910507783.5

(51) Int. Cl.
*G09G 3/32* (2016.01)
*G09G 3/3258* (2016.01)

(52) U.S. Cl.
CPC ..... *G09G 3/3258* (2013.01); *G09G 3/32* (2013.01); *G09G 2310/0251* (2013.01); *G09G 2310/0272* (2013.01); *G09G 2310/062* (2013.01)

(58) Field of Classification Search
CPC ..... G09G 3/32; G09G 2310/0272; G09G 2310/062; G09G 2310/0251;
(Continued)

(56) References Cited

U.S. PATENT DOCUMENTS 5,742,267 A * 4/1998 Wilkinson ..... G09G 3/2011 345/75.2
7,129,914 B2 * 10/2006 Knapp ..... G09G 3/3233 345/76

(Continued)

FOREIGN PATENT DOCUMENTS

CN 1605093 A 4/2005
CN 1674073 A 9/2005

(Continued)

OTHER PUBLICATIONS

China Patent Office, First Office Action dated Apr. 26, 2020, for corresponding Chinese application 201910507783.5.

*Primary Examiner* — Michael J Jansen, II
(74) *Attorney, Agent, or Firm* — Houtteman Law LLC

(57) ABSTRACT

The present disclosure provides a pixel circuit, including: a pixel driving circuit coupled to a gate line and a data line and configured to generate a driving current based on a data signal provided by the data line in response to a gate driving signal provided by the gate line and output the driving current through a current output terminal; and a shunt circuit coupled to the gate line and a first control signal line, and configured to control connection/disconnection between a first signal input terminal and a first signal output terminal in response to the gate driving signal and a first control (Continued)

signal provided by the first control signal line. The current output terminal is coupled to a first terminal of a light emitting device and the first signal input terminal, and the first signal output terminal is coupled to a to-be-charged pixel circuit.

18 Claims, 4 Drawing Sheets

(58) Field of Classification Search
CPC ... G09G 2300/0804; G09G 2300/0814; G09G 2300/0842; G09G 3/3258; G09G 3/3208
See application file for complete search history.

(56) References Cited

U.S. PATENT DOCUMENTS

| | | | | |
|---|---|---|---|---|
| 7,489,290 | B2 * | 2/2009 | Shin | G09G 3/325 345/76 |
| 9,443,469 | B2 * | 9/2016 | Rohatgi | G09G 3/3233 |
| 9,495,910 | B2 * | 11/2016 | Rohatgi | G09G 3/006 |
| 9,564,083 | B2 * | 2/2017 | Bae | G09G 3/3266 |
| 9,697,770 | B2 * | 7/2017 | Ma | G09G 3/32 |
| 10,607,540 | B2 * | 3/2020 | Xi | G09G 3/3233 |
| 10,789,891 | B2 * | 9/2020 | Feng | G09G 3/3233 |
| 10,818,228 | B2 * | 10/2020 | Liu | G09G 3/2007 |
| 10,854,698 | B2 * | 12/2020 | So | G09G 3/3233 |
| 10,950,173 | B2 * | 3/2021 | Zheng | G09G 3/3225 |
| 11,189,231 | B2 * | 11/2021 | Jeong | G09G 3/3258 |
| 2003/0117348 | A1 * | 6/2003 | Knapp | H01L 27/3211 345/76 |
| 2005/0110726 | A1 * | 5/2005 | Shin | G09G 3/325 345/76 |
| 2015/0145848 | A1 * | 5/2015 | Rohatgi | G09G 3/006 345/211 |
| 2015/0145850 | A1 * | 5/2015 | Rohatgi | G09G 3/3258 345/212 |
| 2015/0170576 | A1 * | 6/2015 | Bae | G09G 3/3266 345/205 |
| 2016/0247426 | A1 * | 8/2016 | Huang | G02F 1/13624 |
| 2017/0039934 | A1 * | 2/2017 | Ma | G09G 3/32 |
| 2018/0137818 | A1 * | 5/2018 | Kim | G09G 3/3233 |
| 2018/0197476 | A1 * | 7/2018 | Xi | G09G 3/3233 |
| 2019/0103454 | A1 * | 4/2019 | So | H01L 27/3276 |
| 2019/0180685 | A1 * | 6/2019 | Zheng | G09G 3/3225 |
| 2019/0287459 | A1 * | 9/2019 | Liu | G09G 3/3233 |
| 2020/0090592 | A1 * | 3/2020 | Feng | G09G 3/3258 |
| 2020/0175926 | A1 * | 6/2020 | Jeong | G09G 3/325 |

FOREIGN PATENT DOCUMENTS

| | | | |
|---|---|---|---|
| CN | 101000739 | A | 7/2007 |
| CN | 101399020 | A | 4/2009 |
| CN | 104732926 | A | 6/2015 |
| CN | 105206247 | A | 12/2015 |
| CN | 107170409 | A | 9/2017 |
| CN | 107481668 | A | 12/2017 |
| CN | 108389548 | A | 8/2018 |
| CN | 109817159 | A | 5/2019 |
| CN | 110136643 | A | 8/2019 |
| WO | WO2018219127 | A1 | 12/2018 |

* cited by examiner

PIXEL CIRCUIT, DRIVING METHOD THEREOF, DISPLAY SUBSTRATE AND DISPLAY DEVICE

CROSS-REFERENCE TO RELATED APPLICATION

This a National Phase Application filed under 35 U.S.C. 371 as a national sage of PCT/CN2020/094817, filed on Jun. 8, 2020, an application claiming the benefit of priority to Chinese Patent Application No. 201910507783.5 filed on Jun. 12, 2019, the contents of which are incorporated herein in their entirety by reference.

TECHNICAL FIELD

The present disclosure relates to the field of display technology, and in particular, to a pixel circuit, a driving method thereof, a display substrate including the pixel circuit, and a display device.

BACKGROUND

Current-driven light emitting devices have become a mainstream research object for a new generation of display technology because of their advantages such as high efficiency, low power consumption, and high reliability.

However, as display devices have been developed to have high resolution (e.g., resolution of 8 k and higher), conventional pixel circuits for driving display devices have not been applicable. In the case where the length of the display period of one frame is constant, as the resolution increases, the length of the data writing phase of a single pixel circuit is shortened, that is, the duration of writing of a data signal to the pixel circuit is shortened. In this case, it may be difficult to completely write in some data signals with high voltage values, thereby causing abnormal driving current output by the pixel circuit and further causing abnormal light emission of the light emitting devices.

SUMMARY

In one aspect, embodiments of the present disclosure provide a pixel circuit, including:

a pixel driving circuit, coupled to a gate line and a data line, and configured to generate a driving current based on a data signal provided by the data line in response to a gate driving signal provided by the gate line and output the driving current through a current output terminal of the pixel driving circuit; and a shunt circuit, coupled to the gate line and a first control signal line, and configured to control connection/disconnection between a first signal input terminal and a first signal output terminal of the shunt circuit in response to the gate driving signal provided by the gate line and a first control signal provided by the first control signal line, wherein the current output terminal of the pixel driving circuit is coupled to a first terminal of a light emitting device and the first signal input terminal of the shunt circuit, and the first signal output terminal of the shunt circuit is coupled to a to-be-charged pixel circuit.

In some embodiments, the shunt circuit includes: a first write sub-circuit, an output sub-circuit and a reset sub-circuit, the first write sub-circuit, the output sub-circuit and the reset sub-circuit are coupled to a pre-charging control node;

the first write sub-circuit is coupled to the gate line and the first control signal line, and configured to control writing of the first control signal provided by the first control signal line to the pre-charging control node in response to the gate driving signal provided by the gate line;

the output sub-circuit is coupled to the first signal input terminal and the first signal output terminal, and configured to control the connection/disconnection between the first signal input terminal and the first signal output terminal in response to an electrical signal at the pre-charging control node; and the reset sub-circuit is coupled to a first power supply terminal and a second control signal line, and configured to control writing of a first voltage in an inactive level state, provided by the first power supply terminal, to the pre-charging control node in response to a second control signal provided by the second control signal line.

In some embodiments, the first write sub-circuit includes: a first transistor;

a control electrode of the first transistor is coupled to the gate line, a first electrode of the first transistor is coupled to the first control signal line, and a second electrode of the first transistor is coupled to the pre-charging control node.

In some embodiments, the output sub-circuit is configured to connect the first signal input terminal with the first signal output terminal in response to the electrical signal at the pre-charging control node being in an active level state, and to disconnect the first signal input terminal from the first signal output terminal in response to the electrical signal at the pre-charging control node being in the inactive level state.

In some embodiments, the output sub-circuit includes: a second transistor and a first capacitor;

a control electrode of the second transistor is coupled to the pre-charging control node, a first electrode of the second transistor is coupled to the first signal input terminal, and a second electrode of the second transistor is coupled to the first signal output terminal; and a first terminal of the first capacitor is coupled to the pre-charging control node, and a second terminal of the first capacitor is grounded or coupled to a second power supply terminal.

In some embodiments, the reset sub-circuit includes: a third transistor;

a control electrode of the third transistor is coupled to the second control signal line, a first electrode of the third transistor is coupled to the pre-charging control node, and a second electrode of the third transistor is coupled to the first power supply terminal.

In some embodiments, the pixel driving circuit includes: a second write sub-circuit and a drive sub-circuit, the second write sub-circuit and the drive sub-circuit are coupled to a driving control node;

the second write sub-circuit is coupled to the gate line and the data line, and configured to control writing of the data signal provided by the data line to the driving control node in response to the gate driving signal provided by the gate line; and the drive sub-circuit is configured to generate a corresponding driving current in response to an electrical signal at the driving control node and output the driving current through the current output terminal.

In some embodiments, the second write sub-circuit includes: a fourth transistor;

a control electrode of the fourth transistor is coupled to the gate line, a first electrode of the fourth transistor is coupled to the data line, and a second electrode of the fourth transistor is coupled to the driving control node.

In some embodiments, the drive sub-circuit includes: a driving transistor and a second capacitor;

a control electrode of the driving transistor is coupled to the driving control node, a first electrode of the driving transistor is coupled to a third power supply terminal, and a second electrode of the driving transistor is coupled to the current output terminal; and a first terminal of the second capacitor is coupled to the driving control node, and a second terminal of the second capacitor is coupled to a fourth power supply terminal.

In some embodiments, the pixel circuit further includes: a light-emitting control circuit having a second signal input terminal coupled to the current output terminal and the first signal input terminal and a second signal output terminal coupled to the first terminal of the light emitting device. The light-emitting control circuit is further coupled to a light-emitting control signal line, and configured to control connection/disconnection between the second signal input terminal and the second signal output terminal in response to a light-emitting control signal provided by the light-emitting control signal line.

In some embodiments, the light-emitting control circuit includes: a fifth transistor;

a control electrode of the fifth transistor is coupled to the light-emitting control signal line, a first electrode of the fifth transistor is coupled to the second signal input terminal, and a second electrode of the fifth transistor is coupled to the second signal output terminal.

In another aspect, embodiments of the present disclosure further provide a display substrate, including: pixel circuits arranged in an array, and each pixel circuit is any one of the pixel circuits described above.

In some embodiments, the display substrate includes a first pixel circuit and a second pixel circuit, the second pixel circuit is in a row next to a row in which the first pixel circuit is, and a to-be-charged pixel circuit coupled to a first signal output terminal of the first pixel circuit is the second pixel circuit.

In some embodiments, a second control signal line to which a reset sub-circuit of the first pixel circuit is coupled is a gate line to which the second pixel circuit is coupled.

In some embodiments, a first signal output terminal of the first pixel circuit is coupled to a driving control node of the second pixel circuit.

In some embodiments, the pixel circuits in a same column are coupled to a same first control signal line, and the pixel circuits in different columns are coupled to different first control signal lines.

In another aspect, embodiments of the present disclosure further provide a display device including a display substrate, and the display substrate is any one of the display substrates described above.

In another aspect, embodiments of the present disclosure further provide a pixel driving method for a pixel circuit, wherein the pixel circuit is any one of the pixel circuits described above, and the pixel driving method includes:

in a data writing phase, providing a gate driving signal in an active level state, a data signal and a first control signal, so that the pixel driving circuit generates a driving current according to the data signal and outputs the driving current through the current output terminal, and the shunt circuit controls connection/disconnection between the first signal input terminal and the first signal output terminal in response to the first control signal.

In some embodiments, in response to the first control signal being in the active level state, the shunt circuit connects the first signal input terminal with the first signal output terminal to divide the driving current and output a divided current to the to-be-charged pixel circuit.

DETAILED DESCRIPTION

Figure 1:
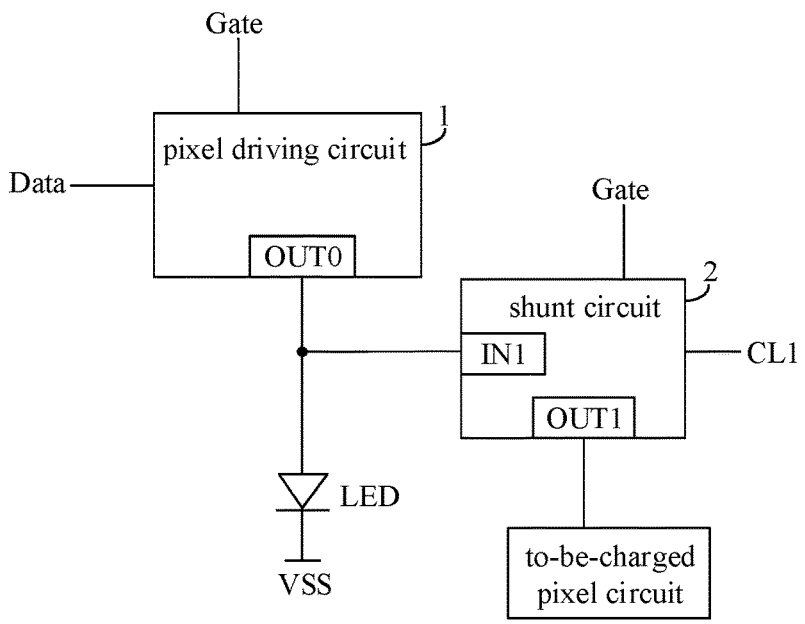
FIG. 1 is a schematic structural diagram of a pixel circuit according to an embodiment of the present disclosure.

In order to make those skilled in the art better understand the technical solutions of the present disclosure, a pixel circuit, a driving method thereof, a display substrate, and a display device according to the present disclosure are described in detail below with reference to the accompanying drawings.

It should be noted that the transistor in the present disclosure may be a thin film transistor, a field effect transistor, or other switch device with the same characteristics. A transistor generally includes three electrodes: a gate electrode, a source electrode and a drain electrode, and the source electrode and the drain electrode of the transistor are symmetrical in structure, and are interchangeable as required. In the present disclosure, a control electrode refers to a gate electrode of a transistor, and one of a first electrode and a second electrode is a source electrode and the other of the first electrode and the second electrode is a drain electrode.

Further, transistors may be classified into N-type transistors and P-type transistors according to their characteristics. When a transistor is an N-type transistor, its turn-on voltage is a high level voltage, and its turn-off voltage is a low level voltage; when a transistor is a P-type transistor, its turn-on voltage is a low level voltage and its turn-off voltage is a high level voltage.

In the present disclosure, an "active level state" refers to a state in which a signal is in a voltage state capable of controlling a corresponding transistor to be turned on, and an "inactive level state" refers to a state in which a signal is in a voltage state capable of controlling a corresponding transistor to be turned off. Therefore, when the transistor is an N-type transistor, the active level state refers to a high level state, and the inactive level state refers to a low level state; when the transistor is a P-type transistor, the active level state refers to a low level state, and the inactive level state refers to a high level state.

In the following embodiments, an example will be described in which all transistors in a pixel circuit are N-type transistors. It should be understood by those skilled in the art that, in the case where all transistors in the pixel circuit are N-type transistors, which is only one embodiment of the present disclosure, all transistors in the pixel circuit can be simultaneously manufactured based on a same manufacturing process, and this case does not limit the technical solutions of the present disclosure.

In addition, for any one pixel circuit on a display substrate, the pixel circuit may correspond to one gate line and one data line, and the pixel circuit may include at least: a data writing sub-circuit and a drive sub-circuit, and the data writing sub-circuit and the drive sub-circuit are coupled to a driving control node. Within one frame, each pixel circuit may have at least two operation phases, i.e., a data writing phase and a stable light emitting phase. In the data writing phase, a gate driving signal provided by the gate line corresponding to the pixel circuit is in the active level state, and the data writing sub-circuit writes a data signal provided by the data line into the driving control node in response to the gate driving signal in the active level state, so that the drive sub-circuit generates a corresponding driving current according to an electrical signal at the driving control node. In the stable light emitting phase, the gate driving signal provided by the gate line is in the inactive level state, and the drive sub-circuit can continuously and stably output a driving current to the light emitting device to drive the light emitting device to emit light.

It should be noted that the light emitting device in the present disclosure may be a current-driven light emitting device including a light emitting diode (LED), a micro light emitting diode (Micro LED), or an organic light emitting diode (OLED). In the following embodiments, description is given by taking a case where the light emitting device is an LED as an example.

Figure 6:
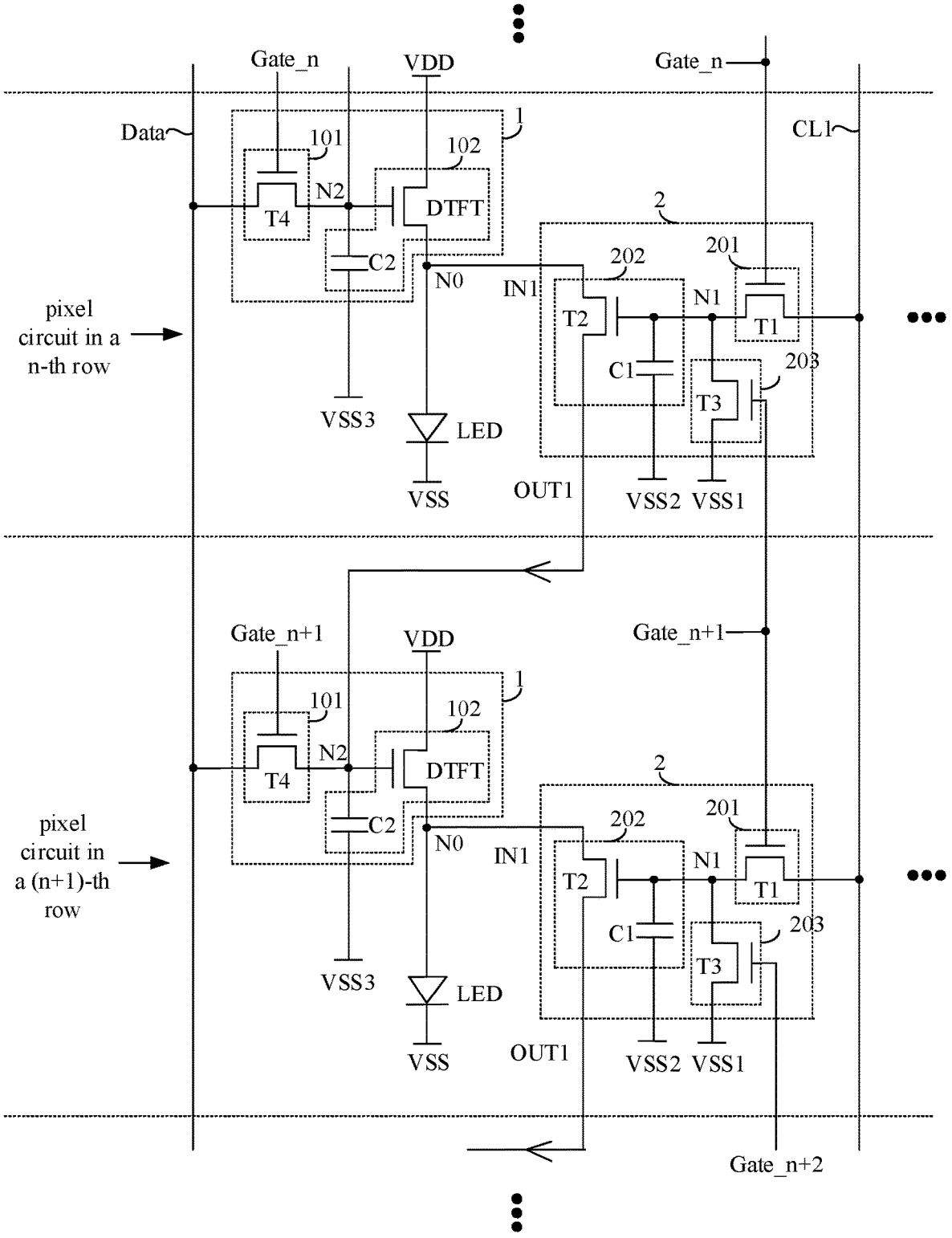
FIG. 6 is a schematic circuit diagram of a display substrate according to an embodiment of the present disclosure.

FIG. 1 is a schematic structural diagram of a pixel circuit according to an embodiment of the present disclosure. As shown in FIG. 1, the pixel circuit includes: a pixel driving circuit 1 and a shunt circuit 2. A current output terminal OUT0 of the pixel driving circuit 1 is coupled to a first terminal of the light emitting device LED and a first signal input terminal IN1 of the shunt circuit 2, and a first signal output terminal OUT1 of the shunt circuit 2 is coupled to a to-be-charged pixel circuit. In some embodiments, as shown in FIG. 6, the first signal output terminal of the shunt circuit 2 is coupled to a driving control node N2 in the to-be-charged pixel circuit. As shown in FIG. 1, a second terminal of the light emitting device LED is coupled to a power supply VSS.

The pixel driving circuit 1 is coupled to a gate line Gate and a data line Data, and the pixel driving circuit 1 is configured to generate a corresponding driving current based on a data signal provided by the data line Data in response to a gate driving signal provided by the gate line Gate in a data writing phase, and output the driving current through the current output terminal OUT0.

The shunt circuit 2 is coupled to the gate line Gate and a first control signal line CL1, and the shunt circuit 2 is configured to control connection/disconnection between the first signal input terminal IN1 and the first signal output terminal OUT1 in response to the gate driving signal provided by the gate line Gate and a first control signal provided by the first control signal line CL1 in the data writing phase. When the first control signal received by the shunt circuit 2 is in the active level state, the shunt circuit 2 connect the first signal input terminal IN1 and the first signal output terminal OUT1, so as to divide the driving current output by the pixel driving circuit 1 and output the divided current to the to-be-charged pixel circuit; when the first control signal received by the shunt circuit 2 is in the inactive level state, the shunt circuit 2 disconnects the first signal input terminal IN1 from the first signal output terminal OUT1.

It should be noted that, in any frame, the data writing phase corresponding to the pixel circuit according to the embodiment of the present disclosure is before the data writing phase corresponding to the to-be-charged pixel circuit. In the present disclosure, the to-be-charged pixel circuit may be a conventional pixel circuit, or have the same circuit structure as the pixel circuit according to the embodiment of the present disclosure.

The pixel circuit according to the embodiment of the present disclosure has a function of pre-charging the to-be-charged pixel circuit. For example, in a certain frame, assuming that the to-be-charged pixel circuit needs to be written with a data signal with a high voltage value, the data signal with the high voltage value may not be completely written into the driving control node in the to-be-charged pixel circuit because the duration of the data writing phase is too short. In view of the above technical problem, the pixel circuit according to the embodiments of the present disclosure may be used to pre-charge the driving control node in the to-be-charged pixel circuit.

In the data writing phase corresponding to the pixel circuit according to the embodiment of the present disclosure, the first control signal in the active level state is provided by an external chip (not shown) to the first control signal line CL1 coupled to the pixel circuit, and at this time, the shunt circuit 2 receives the first control signal in the active level state and the gate driving signal in the active level state provided by the gate line Gate, and makes the first signal input terminal IN1 in conduction with the first signal output terminal OUT1 in response to the first control signal in the active level state and the gate driving signal in the active level state.

Meanwhile, the pixel driving circuit 1 receives the gate driving signal in the active level state provided by the gate line Gate and the data signal provided by the data line Data, generates a corresponding driving current based on the data signal in response to the gate driving signal in the active level state, and outputs the driving current through the current output terminal OUT0. At this time, since the first signal input terminal IN1 (the current output terminal OUT0) is in connection with the first signal output terminal OUT1, the pixel driving circuit 1 branches at the node NO, so that a part of the current is output to the LED, and the other part of the current is output to the to-be-charged pixel circuit through the first signal input terminal IN1 and the first signal output terminal OUT1, so as to pre-charge the driving control node N2 in the to-be-charged pixel circuit.

Thereafter, when entering into the data writing phase corresponding to the to-be-charged pixel circuit, since the driving control node N2 in the to-be-charged pixel circuit has completed the pre-charging, the data signal with the high voltage value can be completely written into the driving control node N2 in the to-be-charged pixel circuit in a short time, ensuring that the voltage at the driving control node N2 in the to-be-charged pixel circuit reaches the desired level.

When the to-be-charged pixel circuit needs to be written with a data signal with a low voltage value, in the data writing phase corresponding to the pixel circuit according to the embodiment, the first control signal in the inactive level state is provided by an external chip (not shown) to the first control signal line CL1 coupled to the pixel circuit, and at this time, the shunt circuit 2 receives the first control signal in the inactive level state and the gate driving signal in the active level state provided by the gate line Gate, and disconnects the first signal input terminal IN1 from the first signal output terminal OUT1 in response to the first control signal in the inactive level state and the gate driving signal in the active level state.

As can be seen from the above, in the present disclosure, by controlling the level state of the first control signal provided by the first control signal line, the connection/disconnection between the first signal input terminal IN1 and the first signal output terminal OUT1 of the shunt circuit can be controlled, so that the to-be-charged pixel circuit can be pre-charged as needed.

Figure 2:
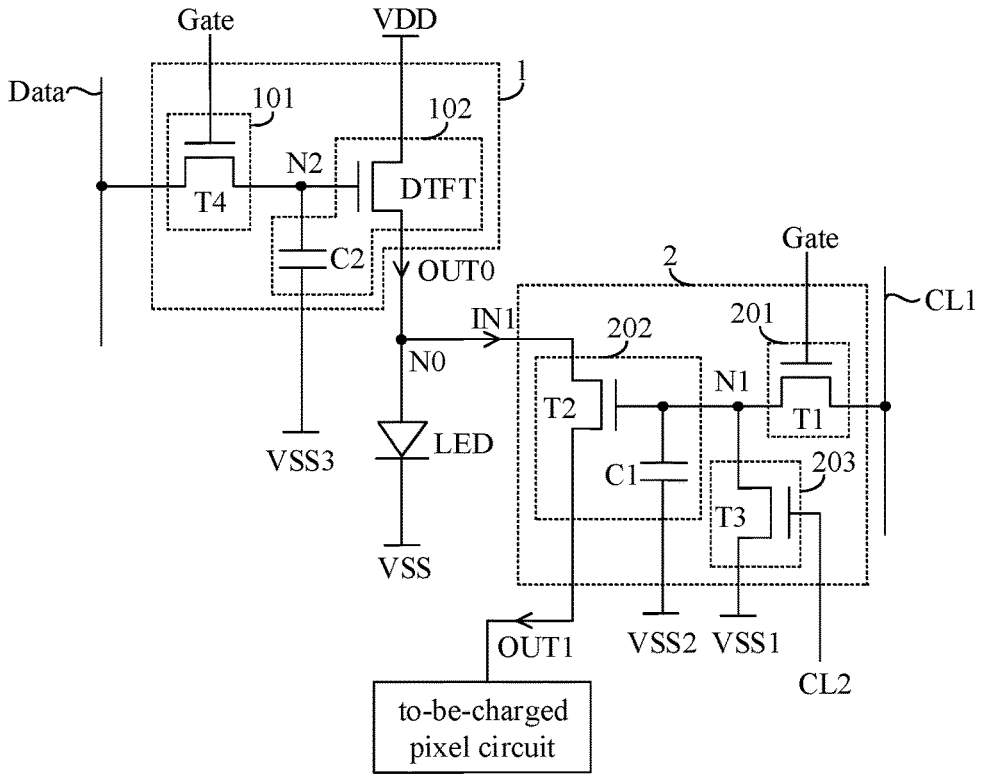
FIG. 2 is a schematic circuit diagram of another pixel circuit according to an embodiment of the present disclosure.

FIG. 2 is a schematic circuit diagram of a pixel circuit according to an embodiment of the present disclosure. The pixel circuit shown in FIG. 2 is one implementation of the pixel circuit shown in FIG. 1.

As shown in FIG. 2, the shunt circuit 2 includes: a first write sub-circuit 201, an output sub-circuit 202 and a reset sub-circuit 203, and the first write sub-circuit 201, the output sub-circuit 202 and the reset sub-circuit 203 are coupled to a pre-charging control node N1.

The first write sub-circuit 201 is coupled to the gate line Gate and the first control signal line CL1; the first write sub-circuit 201 is configured to control writing of the first control signal to the pre-charging control node N1 in response to the gate driving signal provided by the gate line Gate.

The output sub-circuit 202 is coupled to the first signal input terminal IN1 and the first signal output terminal OUT1; the output sub-circuit 202 is configured to control connection/disconnection between the first signal input terminal IN1 and the first signal output terminal OUT1 in response to an electrical signal at the pre-charging control node N1. When the electrical signal at the pre-charging control node N1 is in the active level state, the output sub-circuit 202 makes the first signal input terminal IN1 in connection with the first signal output terminal OUT1; when the electrical signal at the pre-charging control node N1 is in the inactive level state, the output sub-circuit 202 disconnects the first signal input terminal IN1 from the first signal output terminal OUT1.

The reset sub-circuit 203 is coupled to a first power supply terminal VSS1 and a second control signal line CL2; the reset sub-circuit 203 is configured to control writing of a first voltage in the inactive level state provided by the first power supply terminal VSS1 to the pre-charging control node N1 in response to a second control signal provided by the second control signal line CL2.

In some embodiments, the first write sub-circuit 201 includes: a first transistor T1; a control electrode of the first transistor T1 is coupled to the gate line Gate, a first electrode of the first transistor T1 is coupled to the first control signal line CL1, and a second electrode of the first transistor T1 is coupled to the pre-charging control node N1.

In some embodiments, the output sub-circuit 202 includes: a second transistor T2 and a first capacitor C1; a control electrode of the second transistor T2 is coupled to the pre-charging control node N1, a first electrode of the second transistor T2 is coupled to the first signal input terminal IN1, and a second electrode of the second transistor T2 is coupled to the first signal output terminal OUT1; a first terminal of the first capacitor C1 is coupled to the pre-charging control node N1, and a second terminal of the first capacitor C1 is grounded or coupled to a second power supply terminal VSS2.

In some embodiments, the reset sub-circuit 203 includes: a third transistor T3; a control electrode of the third transistor T3 is coupled to the second control signal line CL2, a first electrode of the third transistor T3 is coupled to the pre-charging control node N1, and a second electrode of the third transistor T3 is coupled to the first power supply terminal VSS1.

In an embodiment of the present disclosure, as shown in FIG. 2, the pixel driving circuit 1 includes: a second write sub-circuit 101 and a drive sub-circuit 102 which are coupled to each other at the driving control node N2.

The second write sub-circuit 101 is coupled to the gate line Gate and the data line Data; the second write sub-circuit 101 is configured to control writing of the data signal provided by the data line Data to the driving control node N2 in response to the gate driving signal provided by the gate line Gate; the drive sub-circuit 102 is configured to generate a corresponding driving current in response to the electrical signal at the driving control node N2 and output the driving current through the current output terminal OUT0.

In some embodiments, the second write sub-circuit 101 includes: a fourth transistor T4; a control electrode of the fourth transistor T4 is coupled to the gate line Gate, a first electrode of the fourth transistor T4 is coupled to the data line Data, and a second electrode of the fourth transistor T4 is coupled to the driving control node N2.

In some embodiments, the drive sub-circuit 102 includes: a driving transistor DTFT and a second capacitor C2; a control electrode of the driving transistor DTFT is coupled to the driving control node N2, a first electrode of the driving transistor DTFT is coupled to a third power supply terminal VDD, and a second electrode of the driving transistor DTFT is coupled to the current output terminal OUT0; a first terminal of the second capacitor C2 is coupled to the driving control node N2, and a second terminal of the second capacitor C2 is coupled to a fourth power supply terminal VSS3.

The operation of the pixel circuit shown in FIG. 2 will be described in detail below with reference to the accompanying drawings. Considering that all the transistors are N-type transistors, the first power supply terminal VSS1 supplies a low level operating voltage and the third power supply terminal VDD supplies a high-level operating voltage. The second power supply terminal VSS2 and the fourth power supply terminal VSS3 may supply an operating voltage having a constant voltage value, for example, the second power supply terminal VSS2 and the fourth power supply terminal VSS3 supply a low level operating voltage. In addition, it is assumed that the to-be-charged pixel circuit needs to be pre-charged (the first control signal is in a high-level state in the data writing phase).

Figure 3:
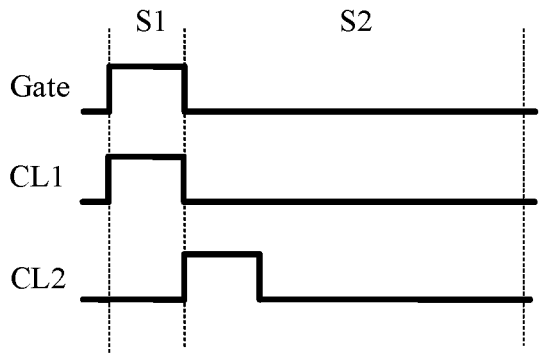
FIG. 3 is an operation timing diagram of the pixel circuit shown in FIG. 2.

FIG. 3 is an operation timing diagram of the pixel circuit shown in FIG. 2. As shown in FIG. 3, the operation process of the pixel circuit includes: a data writing phase S1 and a stable light emitting phase S2.

In the data writing phase S1, the gate driving signal provided by the gate line Gate is in a high level state, the first control signal provided by the first control signal line CL1 is in a high level state, and the second control signal provided by the second control signal line CL2 is in a low level state. At this time, the first transistor T1 and the fourth transistor T4 are in a turn-on state; the third transistor T3 is in a turned-off state.

Since the fourth transistor T4 is turned on, the data signal provided by the data line Data is written to the driving control node N2 through the fourth transistor T4, and the driving transistor DTFT outputs a driving current according to the voltage at the driving control node N2. According to the saturated driving current formula of the driving transistor DTFT, the driving current I output by the driving transistor DTFT is:

$$I = K*(Vgs - Vth_{_DTFT})^2$$
$$= K*(Vdata - VDD - Vth_{_DTFT})^2$$

It should be noted that K is a constant (the value thereof is determined by the size and electrical characteristics of the driving transistor DTFT), Vgs is a gate-source voltage of the driving transistor DTFT, Vdata is a voltage magnitude corresponding to the data signal, and $Vth_{_DTFT}$ is a threshold voltage of the driving transistor DTFT.

Meanwhile, since the first transistor T1 is turned on, the first control signal in the high level state is written to the pre-charging control node N1 through the first transistor T1, so that the electrical signal at the pre-charging control node N1 is in the high level state, and at this time, the second transistor T2 is turned on; thereby, connection is made between the first signal input terminal IN1 and the first signal output terminal OUT1 in the shunt circuit 2. Therefore, a part of the driving current output by the driving transistor DTFT flows to the light emitting device, and the other part thereof flows to the to-be-charged pixel circuit through the second transistor T2, and a ratio of the two parts of the current is determined by total loads in the two branches. The current flowing to the to-be-charged pixel circuit pre-charges the driving control node N2 in the to-be-charged pixel circuit.

In the stable light emitting phase S2, the gate driving signal provided by the gate line Gate is in the low level state, the first control signal provided by the first control signal line CL1 is in the low level state, and the second control signal provided by the second control signal line CL2 is in the high level state at first and is then switched to the low level state. In the present disclosure, the second control signal may also be continuously in the high level state during the stable light emitting phase (this case is not shown). It should be noted that, in the present disclosure, it is only necessary to ensure that the duration during which the second control signal is kept at the high level is long enough to allow the low level operating voltage provided by the first power supply terminal VSS1 to be completely written into the pre-charging control node N1.

Only the case where the second control signal is in the high level state in the stable light emitting phase S2 will be described below. In this case, the third transistor T3 is in the turn-on state; the first transistor T1 and the fourth transistor T4 are in the turn-off state.

Since the fourth transistor T4 is turned off, the driving control node N2 is in a floating state, the voltage of the driving control node N2 is maintained at Vdata under the action of the second capacitor C2, and the driving transistor DTFT stably outputs a driving current I, where $I=K*(Vdata-VDD-Vth_{_DFTF})^2$.

Since the first transistor T1 is turned off and the third transistor T3 is turned on, the low level operating voltage provided by the first power supply terminal VSS1 is written to the pre-charging control node N1 through the third transistor T3, and at this time, the pre-charging control node N1 is in the low level state, and the second transistor T2 is turned off; at this point, the first signal input terminal IN1 and the first signal output terminal OUT1 in the shunt circuit 2 are disconnected. The shunt circuit 2 does not divide the driving current output by the driving transistor DTFT, and the driving current I ($I=K*(Vdata-VDD-Vth_{_DTFT})^2$) output by the driving transistor DTFT flows to the light emitting device, ensuring continuous and stable light emission of the light emitting device in the stable light emitting phase.

In practical applications, it is found that the current output by the driving transistor DTFT is unstable in the data writing phase S1, and there is a significant fluctuation in the luminance of the light emitting device. In addition, when the pixel circuit needs to pre-charge the to-be-charged pixel circuit, at the transition time between the end of the data writing phase and the beginning of the stable light emitting phase, the driving current flowing to the light emitting device jumps (the branch corresponding to the shunt circuit 2 is disconnected), that is, the display brightness of the light emitting device jumps, which affects the display effect.

To solve the above technical problem, the above pixel circuit of the present disclosure may be further improved.

Figure 4:
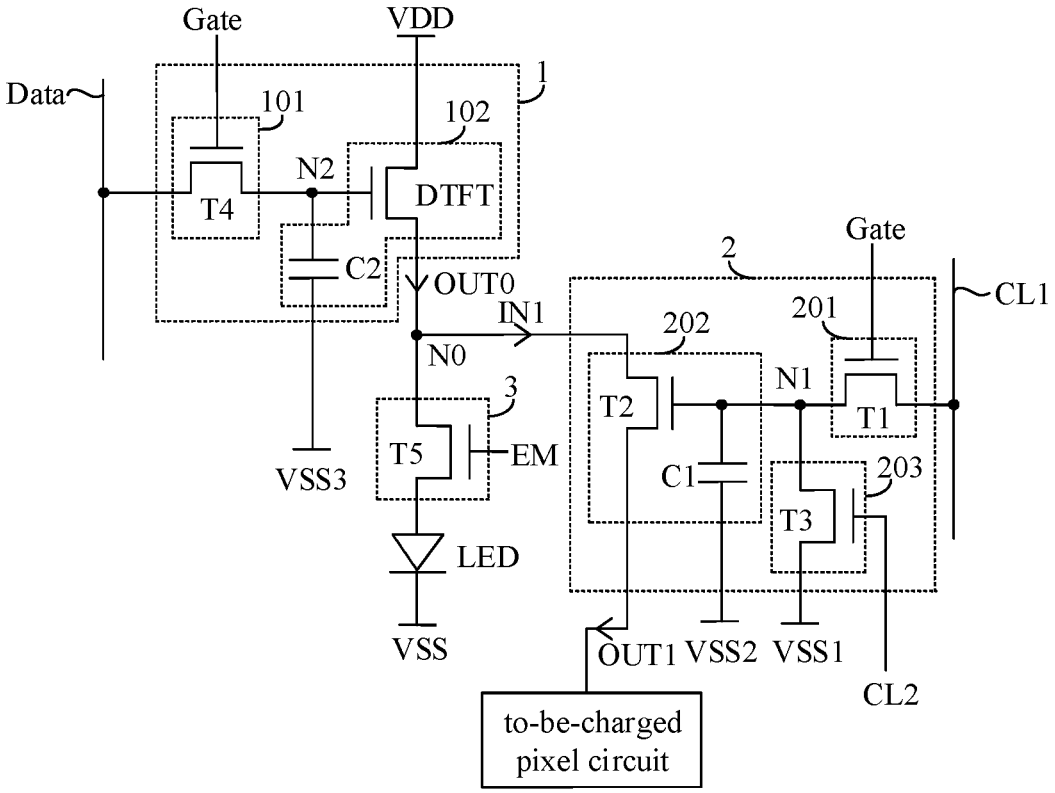
FIG. 4 is a schematic circuit diagram of another pixel circuit according to an embodiment of the present disclosure.

FIG. 4 is a schematic structural diagram of a pixel circuit according to an embodiment of the present disclosure. As shown in FIG. 4, the pixel circuit further includes: a light-emitting control circuit 3, the light-emitting control circuit 3 is arranged between the current output terminal OUT0 and the first terminal of the light emitting device, a second signal input terminal of the light-emitting control circuit 3 is coupled to the current output terminal OUT0 and the first signal input terminal IN1, and a second signal output terminal of the light-emitting control circuit 3 is coupled to the first terminal of the light emitting device.

The light-emitting control circuit 3 is also coupled to a light-emitting control signal line EM, and the light-emitting control circuit 3 is configured to disconnect the second signal input terminal from the second signal output terminal in response to a light-emitting control signal provided by the light-emitting control signal line EM in the data writing phase; and connect the second signal input terminal with the second signal output terminal in response to the light-emitting control signal provided by the light-emitting control signal line EM after the end of the data writing phase.

In some embodiments, the light-emitting control circuit 3 includes: a fifth transistor T5; a control electrode of the fifth transistor T5 is coupled to the light-emitting control signal line EM, a first electrode of the fifth transistor T5 is coupled to the second signal input terminal, and a second electrode of the fifth transistor T5 is coupled to the second signal output terminal.

It should be noted that, for the specific structures of the pixel driving circuit 1 and the shunt circuit 2 in the pixel circuit shown in FIG. 4, reference may be made to the foregoing description of the pixel circuit shown in FIG. 2, and details are not repeated here.

Figure 5:
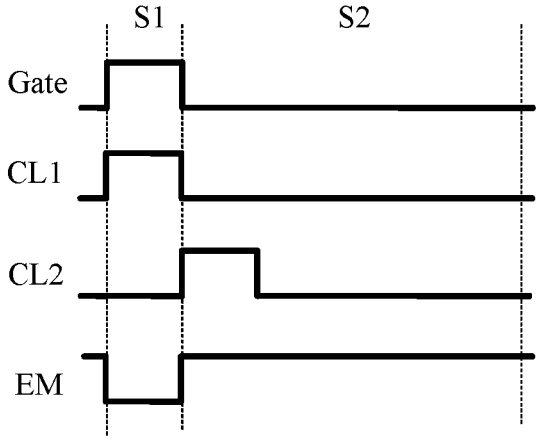
FIG. 5 is an operation timing diagram of the pixel circuit shown in FIG. 4.

FIG. 5 is an operation timing diagram of the pixel circuit shown in FIG. 4. As shown in FIG. 5, the operation process of the pixel circuit includes: a data writing phase S1 and a stable light emitting phase S2. For the operation processes of the pixel driving circuit 1 and the shunt circuit 2, details are not repeated here; only the operation process of the light-emitting control circuit 3 in the pixel circuit will be described in detail below.

In the data writing phase S1, the light-emitting control signal provided by the light-emitting control signal line EM is in the low level state, and thus the fifth transistor T5 is turned off. At this time, the driving current output by the driving transistor DTFT all flows to the branch corresponding to the shunt circuit 2, that is, the driving current output by the driving transistor DTFT is entirely used for pre-charging the driving control node N2 in the to-be-charged pixel circuit.

The unstable current output by the driving transistor DTFT in the data writing phase S1 does not flow to the light emitting device, and thus the light emitting device does not emit light, i.e., the display brightness fluctuation and the display brightness jump do not occur. In addition, during the data writing phase, since the driving current output by the driving transistor DTFT is entirely used to pre-charge the driving control node N2 in the to-be-charged pixel circuit, the charging current is large, and thus the voltage of the driving control node N2 in the to-be-charged pixel circuit can be charged to a relatively high level.

In the stable light emitting phase S2, the light-emitting control signal provided by the light-emitting control signal line EM is in the high level state, and thus the fifth transistor T5 is turned on. The driving current output by the driving transistor DTFT flows to the light emitting device through the fifth transistor T5 to drive the light emitting device to emit light.

It should be noted that, in the embodiments shown in FIG. 2 and FIG. 4, the pixel driving circuit 1 includes the fourth transistor T4, the driving transistor DTFT and the second capacitor C2, constituting a 2T1C circuit (a circuit constituted by 2 thin film transistors and 1 capacitor) structure, which is only an example implementation in the present disclosure and does not limit the technical solutions of the present disclosure. The pixel driving circuit 1 in the present disclosure may be any pixel driving circuit that can be used to output a driving current to drive a light emitting device to emit light.

In addition, in the embodiments shown in FIG. 2 and FIG. 4, the shunt circuit 2 includes the first transistor T1, the second transistor T2, the third transistor T3, and the first capacitor C1, constituting a 3T1C circuit (a circuit constituted by 3 thin film transistors and 1 capacitor) structure, which is only an example implementation in the present disclosure and does not limit the technical solutions of the present disclosure. The shunt circuit 2 in the present disclosure may be any circuit structure that can be used to divide a current, which is not described herein again.

The embodiments of the present disclosure provide a pixel driving method, which is used for driving the pixel circuit according to the embodiments of the present disclosure. The pixel driving method includes:

in a data writing phase, providing a gate driving signal in the active level state, a data signal and a first control signal, so that the pixel driving circuit generates a corresponding driving current according to the received data signal and outputs the driving current through the current output terminal, and the shunt circuit controls connection/disconnection between the first signal input terminal and the first signal output terminal in response to the first control signal.

When the first control signal is in the active level state, the shunt circuit connects the first signal input terminal with the first signal output terminal to divide the driving current and outputs a divided current to the to-be-charged pixel circuit; when the first control signal is in the inactive level state, the shunt circuit disconnects the first signal input terminal from the first signal output terminal.

For the specific description of the above steps, reference may be made to the corresponding description in the foregoing embodiments, which are not described herein again.

FIG. 6 is a schematic circuit diagram of a display substrate according to an embodiment of the present disclosure. As shown in FIG. 6, the display substrate includes: pixel circuits arranged in an array, and the pixel circuit in the array is the pixel circuit according to any one of the foregoing embodiments. For the detailed description of the pixel circuit, reference may be made to the contents of the foregoing embodiments.

It should be noted that FIG. 6 only shows two pixel circuits (a first pixel circuit in a n-th row and a second pixel circuit in a (n+1)-th row, where n is an integer greater than 1) in a same column and in adjacent rows in the array by way of example.

In some embodiments, the shunt circuit 2 includes: the first write sub-circuit 201, the output sub-circuit 202, and the reset sub-circuit 203, and the write sub-circuit 201, the output sub-circuit 202, and the reset sub-circuit 203 are coupled to the pre-charging control node N1. The first write sub-circuit 201 is coupled to the corresponding gate line Gate_n/Gate_n+1 and the first control signal line CL1, and is configured to control writing of the first control signal provided by the first control signal line CL1 to the pre-charging control node N1 in response to the gate driving signal provided by the corresponding gate line Gate_n/Gate_n+1. The output sub-circuit 202 is coupled to the first signal input terminal and the first signal output terminal, and is configured to control connection/disconnection between the first signal input terminal and the first signal output terminal in response to an electrical signal at the pre-charging control node. When the electrical signal at the pre-charging control node is in the active level state, the output sub-circuit 202 connects the first signal input terminal to the first signal output terminal; when the electrical signal at the pre-charging control node is in the inactive level state, the output sub-circuit 202 disconnects the first signal input terminal from the first signal output terminal. The reset sub-circuit 203 is coupled to the first power supply terminal VSS1 and the second control signal line, and is configured to control writing of the first voltage in the inactive level state provided by the first power supply terminal VSS1 to the pre-charging control node in response to the second control signal provided by the second control signal line.

As shown in FIG. 6, the to-be-charged pixel circuit coupled to the first signal output terminal in the first pixel circuit in the n-th row is the second pixel circuit in the (n+1)-th row, and the second control signal line coupled to the reset sub-circuit in the first pixel circuit is the gate line Gate_n+1 corresponding to the second pixel circuit. The first signal output terminal of the first pixel circuit is coupled to the driving control node N2 of the second pixel circuit. The pixel circuits in a same column are coupled to a same first control signal line CL1, and the pixel circuits in different columns are coupled to different first control signal lines CL1.

In this array of the pixel circuits, the pixel circuits in a current row can be used to pre-charge the driving control nodes N2 in the pixel circuits in a next row. The gate line Gate_n+1 corresponding to the pixel circuits in the next row can be used to control resetting of the shunt circuits 2 in the pixel circuits in the current row.

The embodiments of the present disclosure also provide a display device, which includes a display substrate, and the display substrate is the display substrate according to the forgoing embodiments. For the description of the display substrate, reference may be made to the contents in the foregoing embodiments, and details are not repeated herein.

It should be noted that, the display device in the embodiment may be any product or component with a display function, such as an electronic paper, an LED panel, an OLED panel, a mobile phone, a tablet computer, a television, a display, a notebook computer, a digital photo frame, or a navigator.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

The invention claimed is:

1. A pixel circuit, comprising:

a pixel driving circuit, coupled to a gate line and a data line, and configured to generate a driving current based on a data signal provided by the data line in response to a gate driving signal provided by the gate line and output the driving current through a current output terminal of the pixel driving circuit; and a shunt circuit, coupled to the gate line and a first control signal line, and configured to control connection/disconnection between a first signal input terminal and a first signal output terminal of the shunt circuit in response to the gate driving signal provided by the gate line and a first control signal provided by the first control signal line, wherein the current output terminal of the pixel driving circuit is coupled to a first terminal of a light emitting device and the first signal input terminal of the shunt circuit, and the first signal output terminal of the shunt circuit is coupled to a to-be-charged pixel circuit, wherein the shunt circuit comprises: a first write sub-circuit, an output sub-circuit and a reset sub-circuit, the first write sub-circuit, the output sub-circuit and the reset sub-circuit are coupled to a pre-charging control node;

the first write sub-circuit is coupled to the gate line and the first control signal line, and configured to control writing of the first control signal provided by the first control signal line to the pre-charging control node in response to the gate driving signal provided by the gate line;

the output sub-circuit is coupled to the first signal input terminal and the first signal output terminal, and configured to control the connection/disconnection between the first signal input terminal and the first signal output terminal in response to an electrical signal at the pre-charging control node; and the reset sub-circuit is coupled to a first power supply terminal and a second control signal line, and configured to control writing of a first voltage in an inactive level state, provided by the first power supply terminal, to the pre-charging control node in response to a second control signal provided by the second control signal line.

2. The pixel circuit of claim 1, wherein the first write sub-circuit comprises: a first transistor;

a control electrode of the first transistor is coupled to the gate line, a first electrode of the first transistor is coupled to the first control signal line, and a second electrode of the first transistor is coupled to the pre-charging control node.

3. The pixel circuit of claim 2, wherein the output sub-circuit is configured to connect the first signal input terminal with the first signal output terminal in response to the electrical signal at the pre-charging control node being in an active level state, and to disconnect the first signal input terminal from the first signal output terminal in response to the electrical signal at the pre-charging control node being in the inactive level state.

4. The pixel circuit of claim 3, wherein the output sub-circuit comprises: a second transistor and a first capacitor;

a control electrode of the second transistor is coupled to the pre-charging control node, a first electrode of the second transistor is coupled to the first signal input terminal, and a second electrode of the second transistor is coupled to the first signal output terminal; and a first terminal of the first capacitor is coupled to the pre-charging control node, and a second terminal of the first capacitor is grounded or coupled to a second power supply terminal.

5. The pixel circuit of claim 4, wherein the reset sub-circuit comprises: a third transistor;

a control electrode of the third transistor is coupled to the second control signal line, a first electrode of the third transistor is coupled to the pre-charging control node, and a second electrode of the third transistor is coupled to the first power supply terminal.

6. The pixel circuit of claim 5, wherein the pixel driving circuit comprises: a second write sub-circuit and a drive sub-circuit, the second write sub-circuit and the drive sub-circuit are coupled to a driving control node;

the second write sub-circuit is coupled to the gate line and the data line, and configured to control writing of the data signal provided by the data line to the driving control node in response to the gate driving signal provided by the gate line; and the drive sub-circuit is configured to generate a corresponding driving current in response to an electrical signal at the driving control node and output the driving current through the current output terminal.

7. The pixel circuit of claim 6, wherein the second write sub-circuit comprises: a fourth transistor;

a control electrode of the fourth transistor is coupled to the gate line, a first electrode of the fourth transistor is coupled to the data line, and a second electrode of the fourth transistor is coupled to the driving control node.

8. The pixel circuit of claim 7, wherein the drive sub-circuit comprises: a driving transistor and a second capacitor;

a control electrode of the driving transistor is coupled to the driving control node, a first electrode of the driving transistor is coupled to a third power supply terminal, and a second electrode of the driving transistor is coupled to the current output terminal; and a first terminal of the second capacitor is coupled to the driving control node, and a second terminal of the second capacitor is coupled to a fourth power supply terminal.

9. The pixel circuit of claim 8, further comprising:

a light-emitting control circuit having a second signal input terminal coupled to the current output terminal and the first signal input terminal and a second signal output terminal coupled to the first terminal of the light emitting device;

wherein the light-emitting control circuit is further coupled to a light-emitting control signal line, and configured to control connection/disconnection between the second signal input terminal and the second signal output terminal in response to a light-emitting control signal provided by the light-emitting control signal line.

10. The pixel circuit of claim 9, wherein the light-emitting control circuit comprises: a fifth transistor;

a control electrode of the fifth transistor is coupled to the light-emitting control signal line, a first electrode of the fifth transistor is coupled to the second signal input terminal, and a second electrode of the fifth transistor is coupled to the second signal output terminal.

11. A display substrate, comprising: pixel circuits arranged in an array, each pixel circuit being the pixel circuit of claim 1.

12. The display substrate of claim 11, wherein the display substrate comprises a first pixel circuit and a second pixel circuit, the second pixel circuit is in a row next to a row in which the first pixel circuit is, and a to-be-charged pixel circuit coupled to a first signal output terminal of the first pixel circuit is the second pixel circuit.

13. A display substrate, comprising a first pixel circuit and a second pixel circuit, wherein the second pixel circuit is in a row next to a row in which the first pixel circuit is, each of the first and second pixel circuits is the pixel circuit of claim 1, a to-be-charged pixel circuit coupled to a first signal output terminal of the first pixel circuit is the second pixel circuit, and a second control signal line to which the reset sub-circuit of the first pixel circuit is coupled is a gate line to which the second pixel circuit is coupled.

14. A display substrate, comprising a first pixel circuit and a second pixel circuit, wherein the second pixel circuit is in a row next to a row in which the first pixel circuit is, each of the first and second pixel circuits is the pixel circuit of claim 6, a to-be-charged pixel circuit coupled to a first signal output terminal of the first pixel circuit is the second pixel circuit, and a first signal output terminal of the first pixel circuit is coupled to a driving control node of the second pixel circuit.

15. The display substrate of claim 11, wherein pixel circuits in a same column are coupled to a same first control signal line, and pixel circuits in different columns are coupled to different first control signal lines.

16. A display device, comprising the display substrate of claim 11.

17. A pixel driving method for a pixel circuit, wherein the pixel circuit is the pixel circuit of claim 1, and the pixel driving method comprises:

in a data writing phase, providing a gate driving signal in an active level state, a data signal and a first control signal, so that the pixel driving circuit generates a driving current according to the data signal and outputs the driving current through the current output terminal, and the shunt circuit controls connection/disconnection between the first signal input terminal and the first signal output terminal in response to the first control signal.

18. The pixel driving method of claim 17, wherein in response to the first control signal being in the active level state, the shunt circuit connects the first signal input terminal with the first signal output terminal to divide the driving current and output a divided current to the to-be-charged pixel circuit.

* * * * *